US007719344B1

(12) United States Patent
Chen et al.

(10) Patent No.: US 7,719,344 B1
(45) **Date of Patent: *May 18, 2010**

(54) STABILIZATION COMPONENT FOR A SUBSTRATE POTENTIAL REGULATION CIRCUIT

(76) Inventors: Tien-Min Chen, 1049 Jacqueline Way, San Jose, CA (US) 95129; Robert Fu, 10184 Macadam La., Cupertino, CA (US) 95014

( * ) Notice: Subject to any disclaimer, the term of this patent is extended or adjusted under 35 U.S.C. 154(b) by 0 days.

This patent is subject to a terminal disclaimer.

(21) Appl. No.: 11/358,482

(22) Filed: Feb. 21, 2006

Related U.S. Application Data

(63) Continuation of application No. 10/747,022, filed on Dec. 23, 2003, now Pat. No. 7,012,461.

(51) Int. Cl.
*G05F 1/10* (2006.01)
*G05F 3/02* (2006.01)

(52) U.S. Cl. ..... 327/536

(58) Field of Classification Search ..... 327/535–537
See application file for complete search history.

(56) References Cited

U.S. PATENT DOCUMENTS

| | | | |
|---|---|---|---|
| 4,246,517 | A | 1/1981 | Dakroub |
| 4,471,290 | A | 9/1984 | Yamaguchi |
| 4,769,784 | A | 9/1988 | Doluca et al. |
| 4,798,974 | A | 1/1989 | Reczek et al. |
| 4,912,347 | A | 3/1990 | Morris |
| 4,929,621 | A | 5/1990 | Manoury et al. |
| 5,039,877 | A | 8/1991 | Chern |
| 5,086,501 | A | 2/1992 | DeLuca et al. |
| 5,113,088 | A | 5/1992 | Yamamoto et al. |
| 5,124,632 | A | 6/1992 | Greaves |
| 5,167,024 | A | 11/1992 | Smith et al. |
| 5,201,059 | A | 4/1993 | Nguyen |
| 5,204,863 | A | 4/1993 | Saint-Joigny et al. |
| 5,218,704 | A | 6/1993 | Watts, Jr. et al. |
| 5,230,055 | A | 7/1993 | Katz et al. |
| 5,239,652 | A | 8/1993 | Seibert et al. |
| 5,254,883 | A | 10/1993 | Horowitz et al. |
| 5,336,986 | A | 8/1994 | Allman |
| 5,347,172 | A | 9/1994 | Cordoba et al. |
| 5,386,135 | A | 1/1995 | Nakazato et al. |
| 5,394,026 | A | 2/1995 | Yu et al. |
| 5,406,212 | A | 4/1995 | Hashinaga et al. |
| 5,422,591 | A | 6/1995 | Rastegar et al. |
| 5,422,806 | A | 6/1995 | Chen et al. |

(Continued)

FOREIGN PATENT DOCUMENTS

| | | |
|---|---|---|
| EP | 0381021 | 8/1990 |

(Continued)

OTHER PUBLICATIONS

CMOS Circuit Design, Layout and Simulation; R. Jacob Baker, Harry W. Li, David E. Boyce; IEEE Press; 1998.

(Continued)

*Primary Examiner*—Quan Tra

(57) ABSTRACT

A stabilization component for substrate potential regulation for an integrated circuit device. A comparator is coupled to a charge pump to control the charge pump to drive a substrate potential. A stabilization component is coupled to the comparator and is operable to correct an over-charge of the substrate by shunting current from the substrate.

30 Claims, 6 Drawing Sheets

U.S. PATENT DOCUMENTS

| | | | | |
|---|---|---|---|---|
| 5,440,520 | A | 8/1995 | Schutz et al. | |
| 5,447,876 | A | 9/1995 | Moyer et al. | |
| 5,461,266 | A | 10/1995 | Koreeda et al. | |
| 5,483,434 | A | 1/1996 | Seesink | |
| 5,495,184 | A | 2/1996 | Des Rosiers et al. | |
| 5,502,838 | A | 3/1996 | Kikinis | |
| 5,506,541 | A | 4/1996 | Herndon | |
| 5,511,203 | A | 4/1996 | Wisor et al. | |
| 5,519,309 | A | 5/1996 | Smith | |
| 5,560,020 | A | 9/1996 | Nakatani et al. | |
| 5,592,173 | A | 1/1997 | Lau et al. | |
| 5,682,093 | A | 10/1997 | Kivela | |
| 5,692,204 | A | 11/1997 | Rawson et al. | |
| 5,694,072 | A | 12/1997 | Hsiao et al. | |
| 5,717,319 | A | 2/1998 | Jokinen | |
| 5,719,800 | A | 2/1998 | Mittal et al. | |
| 5,727,208 | A | 3/1998 | Brown | |
| 5,744,996 | A | 4/1998 | Kotzle et al. | |
| 5,745,375 | A | 4/1998 | Reinhardt et al. | |
| 5,752,011 | A | 5/1998 | Thomas et al. | |
| 5,754,869 | A | 5/1998 | Holzhammer et al. | |
| 5,757,171 | A | 5/1998 | Babcock | |
| 5,778,237 | A | 7/1998 | Yamamoto et al. | |
| 5,781,060 | A | 7/1998 | Sugawara | |
| 5,812,860 | A | 9/1998 | Horden et al. | |
| 5,815,724 | A | 9/1998 | Mates | |
| 5,818,290 | A * | 10/1998 | Tsukada | 327/537 |
| 5,825,674 | A | 10/1998 | Jackson | |
| 5,838,189 | A | 11/1998 | Jeon | |
| 5,842,860 | A | 12/1998 | Funt | |
| 5,848,281 | A | 12/1998 | Smalley et al. | |
| 5,884,049 | A | 3/1999 | Atkinson | |
| 5,894,577 | A | 4/1999 | MacDonald et al. | |
| 5,900,773 | A | 5/1999 | Susak | |
| 5,920,226 | A | 7/1999 | Mimura | |
| 5,923,545 | A | 7/1999 | Nguyen | |
| 5,929,621 | A | 7/1999 | Angelici et al. | |
| 5,933,649 | A | 8/1999 | Lim et al. | |
| 5,940,020 | A | 8/1999 | Ho | |
| 5,940,785 | A | 8/1999 | Georgiou et al. | |
| 5,940,786 | A | 8/1999 | Steeby | |
| 5,952,871 | A | 9/1999 | Jeon | |
| 5,974,557 | A | 10/1999 | Thomas et al. | |
| 5,986,947 | A * | 11/1999 | Choi et al. | 365/189.11 |
| 5,996,083 | A | 11/1999 | Gupta et al. | |
| 5,996,084 | A | 11/1999 | Watts | |
| 5,999,040 | A | 12/1999 | Do et al. | |
| 6,006,169 | A | 12/1999 | Sandhu et al. | |
| 6,018,264 | A | 1/2000 | Jin | |
| 6,021,500 | A * | 2/2000 | Wang et al. | 713/320 |
| 6,035,407 | A | 3/2000 | Gebara et al. | |
| 6,047,248 | A | 4/2000 | Georgiou et al. | |
| 6,048,746 | A | 4/2000 | Burr | |
| 6,075,404 | A | 6/2000 | Shindoh et al. | |
| 6,078,084 | A | 6/2000 | Nakamura et al. | |
| 6,078,319 | A | 6/2000 | Bril et al. | |
| 6,087,820 | A | 7/2000 | Houghton et al. | |
| 6,087,892 | A | 7/2000 | Burr | |
| 6,091,283 | A | 7/2000 | Murgula et al. | |
| 6,100,751 | A | 8/2000 | De et al. | |
| 6,118,306 | A | 9/2000 | Orton et al. | |
| 6,119,241 | A | 9/2000 | Michail et al. | |
| 6,141,762 | A | 10/2000 | Nicol et al. | |
| 6,157,092 | A | 12/2000 | Hofmann | |
| 6,202,104 | B1 | 3/2001 | Ober | |
| 6,215,235 | B1 | 4/2001 | Osamura | |
| 6,216,235 | B1 | 4/2001 | Thomas et al. | |
| 6,218,708 | B1 | 4/2001 | Burr | |
| 6,226,335 | B1 | 5/2001 | Prozorov | |
| 6,229,379 | B1 * | 5/2001 | Okamoto | 327/535 |
| 6,232,830 | B1 * | 5/2001 | Fournel | 327/540 |
| 6,259,612 | B1 | 7/2001 | Itoh | |
| 6,272,642 | B2 | 8/2001 | Pole et al. | |
| 6,279,048 | B1 | 8/2001 | Ardekani et al. | |
| 6,281,716 | B1 * | 8/2001 | Mihara | 327/80 |
| 6,303,444 | B1 | 10/2001 | Burr | |
| 6,304,824 | B1 | 10/2001 | Bausch et al. | |
| 6,305,407 | B1 | 10/2001 | Selby | |
| 6,311,287 | B1 | 10/2001 | Dischler et al. | |
| 6,314,522 | B1 | 11/2001 | Chu et al. | |
| 6,320,453 | B1 | 11/2001 | Manning | |
| 6,337,593 | B1 | 1/2002 | Mizuno et al. | |
| 6,345,362 | B1 | 2/2002 | Bertin et al. | |
| 6,345,363 | B1 | 2/2002 | Kendler | |
| 6,347,379 | B1 | 2/2002 | Dai et al. | |
| 6,370,046 | B1 | 4/2002 | Nebrigic et al. | |
| 6,373,323 | B2 | 4/2002 | Kuroda | |
| 6,373,325 | B1 | 4/2002 | Kuriyama | |
| 6,378,081 | B1 | 4/2002 | Hammond | |
| 6,388,432 | B2 | 5/2002 | Uchida | |
| 6,415,388 | B1 | 7/2002 | Browning et al. | |
| 6,424,203 | B1 | 7/2002 | Bayadroun | |
| 6,424,217 | B1 | 7/2002 | Kwong | |
| 6,425,086 | B1 | 7/2002 | Clark et al. | |
| 6,427,211 | B2 | 7/2002 | Watts et al. | |
| 6,442,746 | B1 | 8/2002 | James et al. | |
| 6,457,135 | B1 | 9/2002 | Cooper | |
| 6,466,077 | B1 | 10/2002 | Miyazaki et al. | |
| 6,469,573 | B2 | 10/2002 | Kanda et al. | |
| 6,476,632 | B1 | 11/2002 | La Rosa et al. | |
| 6,477,654 | B1 | 11/2002 | Dean et al. | |
| 6,486,729 | B2 | 11/2002 | Imamiya | |
| 6,487,668 | B2 | 11/2002 | Thomas et al. | |
| 6,489,224 | B1 | 12/2002 | Burr | |
| 6,496,027 | B1 | 12/2002 | Sher et al. | |
| 6,496,057 | B2 | 12/2002 | Wada et al. | |
| 6,865,116 | B2 | 12/2002 | Kim et al. | |
| 6,510,400 | B1 | 1/2003 | Moriyama | |
| 6,510,525 | B1 | 1/2003 | Nookala et al. | |
| 6,513,124 | B1 | 1/2003 | Furuichi et al. | |
| 6,518,828 | B2 | 2/2003 | Seo et al. | |
| 6,519,706 | B1 | 2/2003 | Ogoro | |
| 6,529,421 | B1 | 2/2003 | Ogoro | |
| 6,531,912 | B2 | 3/2003 | Katou | |
| 6,570,371 | B1 | 5/2003 | Volk | |
| 6,574,577 | B2 | 6/2003 | Stapleton et al. | |
| 6,574,739 | B1 | 6/2003 | Kung et al. | |
| 6,600,346 | B1 | 7/2003 | Macaluso | |
| 6,617,656 | B2 | 9/2003 | Lee et al. | |
| 6,642,774 | B1 | 11/2003 | Li | |
| 6,675,360 | B1 | 1/2004 | Cantone et al. | |
| 6,677,643 | B2 | 1/2004 | Cantone et al. | |
| 6,700,434 | B2 | 3/2004 | Fujii | |
| 6,731,221 | B1 | 5/2004 | Dioshongh et al. | |
| 6,737,909 | B2 | 5/2004 | Jaussi et al. | |
| 6,741,118 | B2 | 5/2004 | Uchikoba et al. | |
| 6,771,115 | B2 | 8/2004 | Nakano | |
| 6,774,705 | B2 | 8/2004 | Miyazaki et al. | |
| 6,784,722 | B2 | 8/2004 | Tang et al. | |
| 6,791,146 | B2 | 9/2004 | Lai et al. | |
| 6,791,212 | B2 | 9/2004 | Pulvirenti et al. | |
| 6,792,379 | B2 | 9/2004 | Ando | |
| 6,803,633 | B2 | 10/2004 | Mergens et al. | |
| 6,809,968 | B2 | 10/2004 | Marr et al. | |
| 6,882,172 | B1 | 4/2005 | Suzuki et al. | |
| 6,889,331 | B2 | 5/2005 | Soerensen et al. | |
| 6,906,582 | B2 | 6/2005 | Kase et al. | |
| 6,917,240 | B2 | 7/2005 | Trafton et al. | |
| 6,922,783 | B2 | 7/2005 | Knee et al. | |
| 6,927,620 | B2 | 8/2005 | Sendu | |
| 6,936,898 | B2 | 8/2005 | Pelham et al. | |
| 6,967,522 | B2 | 11/2005 | Chandrakasan et al. | |
| 6,986,068 | B2 | 1/2006 | Togawa | |
| 6,992,508 | B2 | 1/2006 | Chow | |

| | | | |
|---|---|---|---|
| 7,012,461 | B1 | 3/2006 | Chen et al. |
| 7,030,681 | B2 | 4/2006 | Yamazaki et al. |
| 7,100,061 | B2 | 8/2006 | Halepete et al. |
| 7,119,604 | B2 | 10/2006 | Chih |
| 7,120,804 | B2 | 10/2006 | Tschanz et al. |
| 7,188,261 | B1 | 3/2007 | Tobias et al. |
| 7,228,242 | B2 | 6/2007 | Read et al. |
| 7,362,165 | B1 | 4/2008 | Chen |
| 7,562,233 | B1 | 7/2009 | Sheng et al. |
| 7,649,402 | B1 | 1/2010 | Chen |
| 2001/0028577 | A1 | 10/2001 | Sung et al. |
| 2002/0011650 | A1 | 1/2002 | Nishizawa et al. |
| 2002/0026597 | A1 | 2/2002 | Dai et al. |
| 2002/0067638 | A1 | 6/2002 | Kobayashi et al. |
| 2002/0073348 | A1 | 6/2002 | Tani |
| 2002/0083356 | A1 | 6/2002 | Dai |
| 2002/0087219 | A1 | 7/2002 | Dai |
| 2002/0087896 | A1 | 7/2002 | Cline et al. |
| 2002/0116650 | A1 | 8/2002 | Halepete et al. |
| 2002/0130701 | A1 | 9/2002 | Kleveland |
| 2002/0138778 | A1 | 9/2002 | Cole et al. |
| 2002/0140494 | A1 | 10/2002 | Thomas et al. |
| 2002/0194509 | A1 | 12/2002 | Plante et al. |
| 2003/0006590 | A1 | 1/2003 | Aoki et al. |
| 2003/0036876 | A1 | 2/2003 | Fuller, III et al. |
| 2003/0065960 | A1 | 4/2003 | Rusu et al. |
| 2003/0071657 | A1 | 4/2003 | Soerensen et al. |
| 2003/0074591 | A1 | 4/2003 | McClendon et al. |
| 2003/0098736 | A1 | 5/2003 | Uchikoba et al. |
| 2003/0189465 | A1 | 10/2003 | Abadeer et al. |
| 2004/0010330 | A1 | 1/2004 | Chen |
| 2004/0025061 | A1 | 2/2004 | Lawrence |
| 2004/0073821 | A1 | 4/2004 | Naveh et al. |
| 2004/0103330 | A1 | 5/2004 | Bonnett |
| 2004/0108881 | A1 | 6/2004 | Bokui et al. |
| 2004/0246044 | A1 | 12/2004 | Myono et al. |
| 2005/0225376 | A1 | 10/2005 | Kin Law |
| 2007/0283176 | A1 | 12/2007 | Tobias et al. |

FOREIGN PATENT DOCUMENTS

| | | |
|---|---|---|
| EP | 0501655 | 2/1992 |
| EP | 0474963 | 3/1992 |
| EP | 0504655 | 9/1992 |
| EP | 0624909 | 11/1997 |
| EP | 0978781 | 9/2000 |
| EP | 1398639 | 3/2004 |
| JP | 63223480 | 9/1988 |
| JP | 04114365 | 4/1992 |
| JP | 409185589 | 7/1997 |
| JP | 11-118845 | 4/1999 |
| JP | 200172383 | 6/2000 |
| JP | 2001345693 | 12/2001 |
| JP | 2003324735 | 11/2003 |
| WO | 0127728 | 4/2001 |
| WO | 0238828 | 5/2002 |
| WO | 03/041403 | 7/2004 |

OTHER PUBLICATIONS

Non Final Office Action, Mail Date Mar. 20, 2008; U.S. Appl. No. 10/747,016.
Non Final Office Action, Mail Date May 16, 2007; U.S. Appl. No. 10/747,016.
Non Final Office Action, Mail Date Jun. 23, 2006; U.S. Appl. No. 10/747,016.
Non Final Office Action, Mail Date Nov. 18, 2005; U.S. Appl. No. 10/747,016.
Non Final Office Action, Mail Date Dec. 22, 2004; U.S. Appl. No. 10/747,016.
Notice of Allowance, Mail Date Mar. 13, 2009; U.S. Appl. No. 10/747,016.
Notice of Allowance, Mail Date Aug. 20, 2009; U.S. Appl. No. 10/747,016.
Notice of Allowance, Mail Date Aug. 27, 2008; U.S. Appl. No. 10/747,016.
Notice of Allowance, Mail Date Dec. 18, 2008; U.S. Appl. No. 10/747,016.
Final Office Action, Mail Date Jan. 12, 2009; U.S. Appl. No. 10/746,539.
Final Office Action, Mail Date Apr. 2, 2008; U.S. Appl. No. 10/746,539.
Final Office Action, Mail Date Apr. 11, 2005; U.S. Appl. No. 10/746,539.
Final Office Action, Mail Date Jun. 15, 2007; U.S. Appl. No. 10/746,539.
Final Office Action, Mail Date Aug. 31, 2006; U.S. Appl. No. 10/746,539.
Final Office Action, Mail Date Dec. 19, 2005; U.S. Appl. No. 10/746,539.
Non Final Office Action, Mail Date Jan. 23, 2007; U.S. Appl. No. 10/746,539.
Non Final Office Action, Mail Date Apr. 11, 2006; U.S. Appl. No. 10/746,539.
Non Final Office Action, Mail Date Jun. 2, 2009; U.S. Appl. No. 10/746,539.
Non Final Office Action, Mail Date Aug. 11, 2005; U.S. Appl. No. 10/746,539.
Non Final Office Action, Mail Date Nov. 30, 2007; U.S. Appl. No. 10/746,539.
Non Final Office Action, Mail Date Aug. 25, 2008; U.S. Appl. No. 10/746,539.
Non Final Office Action, Mail Date Dec. 10, 2004; U.S. Appl. No. 10/746,539.
Non Final Office Action, Mail Date Dec. 22, 2004; U.S. Appl. No. 10/747,022.
Notice of Allowance, Mail Date Sep. 28, 2005; U.S. Appl. No. 10/747,022.
Non Final Office Action, Mail Date Feb. 3, 2009; U.S. Appl. No. 10/874,407.
Non Final Office Action, Mail Date Aug. 9, 2006; U.S. Appl. No. 10/874,407.
Notice of Allowance, Mail Date Jul. 13, 2009; U.S. Appl. No. 10/874,407.
Notice of Allowance, Mail Date Oct. 1, 2008; U.S. Appl. No. 10/874,407.
Non Final Office Action, Mail Date Jun. 20, 2007; U.S. Appl. No. 10/874,772.
Non Final Office Action, Mail Date Sep. 6, 2006; U.S. Appl. No. 10/874,772.
Notice of Allowance, Mail Date Apr. 2, 2008; U.S. Appl. No. 10/874,772.
Notice of Allowance, Mail Date Nov. 20, 2007; U.S. Appl. No. 10/874,772.
Final Office Action, Mail Date Mar. 9, 2008; U.S. Appl. No. 12/107,733.
Non Final Office Action, Mail Date May 21, 2009; U.S. Appl. No. 12/107,733.
Non Final Office Action, Mail Date Sep. 26, 2008; U.S. Appl. No. 12/107,733.
"Computer Software", Wikipedia, http://en.wikipedia.org/wiki/software, retrieved May 2, 2007.
"High Speed Digitally Adjusted Step-Down Controllers for Notebook CPUS"; Max1710/Max1711; MAXIM Manual; p. 11 and p. 21, Jan. 2000.
"Operatio U (Refer to Functional Diagram)" TLC1736; Linear Technology Manual p. 9, Jan. 1999.
"Shmoo plotting: the black art of IC testing", (Baker et al.), IEEE design & test of computers, pp. 90-97, Jul. 1997 [XP783305].
"Wafer Burn-In Isolation Circuit", IBM Technical Disclosure Bulletin, IBM Corp., New York, US, vol. 32, No. 6B, Nov. 1, 1989, pp. 442-443, XP00073858 ISSN:0018-8689 the whole document.
Desai et al., "Sizing of Clock Distribution Networks for High Performance CPU Chips", Digital Equipment Corporation, Hudson, MA, pp. 389-394, 1996.

Hsu, Jui-Ching, "Fabrication of Single Walled Carbon Nanotube (SW-CNT) Cantilevers for Chemical Sensing", M. Sc Thesis, Louisiana State University, Dec. 2007.
International Preliminary Examination Report 157WO, Oct. 1, 2005.
International Preliminary Examining Authority, Written Opinion 157WO, Aug. 10, 2004.
International Search Report 157WO, May 10, 2004.
Merriam-webster's Collegiate Dictionary, tenth edition, pp. 252 and 603 (Merriam-Webster Inc., Springfield, Mass, USA), Jan. 1998.
Oner, H. et al., "A compact monitoring circuit for real-time on-chip diagnosis of hot-carrier induced degradation", Microelectronic Test Structures, 1997. ICMTS 1997. Proceedings, IEEE International Conference on Monterey, CA, Mar. 17, 1997-Mar. 20, 1997, pp. 72-76.
Final Office Action, Mail Date Dec. 7, 2006; U.S. Appl. No. 10/747,016.
Advisory Action; Mail Date May 7, 2007; U.S. Appl. No. 10/334,918.
Final Office Action, Mail Date Jan. 31, 2007; U.S. Appl. No. 10/334,918.
Final Office Action, Mail Date Feb. 15, 2006; U.S. Appl. No. 10/334,918.
Final Office Action, Mail Date Oct. 30, 2006; U.S. Appl. No. 10/334,918.
Final Office Action, Mail Date Nov. 26, 2008; U.S. Appl. No. 10/334,918.
Non Final Rejection, Mail Date Feb. 18, 2009; U.S. Appl. No. 10/334,918.
Non Final Rejection, Mail Date May 13, 2008; U.S. Appl. No. 10/334,918.
Non Final Rejection, Mail Date May 15, 2006; U.S. Appl. No. 10/334,918.
Non Final Rejection, Mail Date Jun. 13, 2006; U.S. Appl. No. 10/334,918.
Final Office Action, Mail Date Jan. 6, 2009; U.S. Appl. No. 10/334,919.
Final Office Action, Mail Date Feb. 21, 2007; U.S. Appl. No. 10/334,919.
Final Office Action, Mail Date Mar. 9, 2006; U.S. Appl. No. 10/334,919.
Non Final Rejection, Mail Date May 15, 2007; U.S. Appl. No. 10/334,919.
Non Final Rejection, Mail Date May 28, 2009; U.S. Appl. No. 10/334,919.
Non Final Rejection, Mail Date Jun. 13, 2005; U.S. Appl. No. 10/334,919.
Non Final Rejection, Mail Date Jul. 21, 2008; U.S. Appl. No. 10/334,919.
Non Final Rejection, Mail Date Aug. 7, 2006; U.S. Appl. No. 10/334,919.
Non Final Rejection, Mail Date Nov. 23, 2007; U.S. Appl. No. 10/334,919.
Notice of Allowance, Mail Date Jan. 5, 2005; U.S. Appl. No. 10/334,748.
Notice of Allowance, Mail Date Aug. 10, 2006; U.S. Appl. No. 10/334,748.
Notice of Allowance, Mail Date Sep. 22, 2005; U.S. Appl. No. 10/334,748.
Non Final Office Action, Mail Date Jun. 24, 2004; U.S. Appl. No. 10/334,748.
Non Final Office Action, Mail Date Aug. 21, 2007; U.S. Appl. No. 10/951,835.
Restriction Requirement, Mail Date Mar. 19, 2007; U.S. Appl. No. 10/951,835.
Restriction Requirement, Mail Date May 28, 2008; U.S. Appl. No. 11/810,516.
Final Office Action, Mail Date Oct. 30, 2007; U.S. Appl. No. 10/747,016.
Final Office Action, Mail Date Apr. 13, 2005; U.S. Appl. No. 10/747,015.
Final Office Action, Mail Date Dec. 2, 2005; U.S. Appl. No. 10/747,015.
Non Final Office Action, Mail Date Jul. 29, 2005; U.S. Appl. No. 10/747,015.
Non Final Office Action, Mail Date Dec. 23, 2004; U.S. Appl. No. 10/747,015.
Notice of Allowance, Mail Date Jun. 21, 2006; U.S. Appl. No. 10/747,015.
Non Final Office Action, Mail Date Apr. 18, 2006; U.S. Appl. No. 10/747,015.
Non Final Office Action, Mail Date Aug. 1, 2007; U.S. Appl. No. 11/591,431.
Notice of Allowance, Mail Date Nov. 23, 2007; U.S. Appl. No. 11/591,431.
Final Office Action, Mail Date Apr. 22, 2005; U.S. Appl. No. 10/747,016.
Supplemental Notice of Allowance, Mail Date Dec. 13, 2007; U.S. Appl. No. 11/591,431.
Final Office Action, Mail Date Aug. 4, 2009; U.S. Appl. No. 10/334,918.
Non Final Office Action, Mail Date Feb. 4, 2010; U.S. Appl. No. 10/334,918.
Non Final Office Action; Mail Date Jan. 5, 2010; U.S. Appl. No. 10/334,919.
Advisory Action; Mail Date Jan. 11, 2010; U.S. Appl. No. 12/107,733.
Non Final Office Action; Mail Date Feb. 24, 2010; U.S. Appl. No. 12/107,733.

* cited by examiner

STABILIZATION COMPONENT FOR A SUBSTRATE POTENTIAL REGULATION CIRCUIT

CROSS REFERENCE TO RELATED APPLICATIONS

This patent application is a Continuation of commonly-owned patent application Ser. No. 10/747,022, filed on Dec. 23, 2003, now U.S. Pat. No. 7,012,461 entitled "A STABILIZATION COMPONENT FOR A SUBSTRATE POTENTIAL REGULATION CIRCUIT", by Chen et al., which is incorporated herein by reference.

This case is related to commonly assigned U.S. patent application "A PRECISE CONTROL COMPONENT FOR A SUBSTRATE POTENTIAL REGULATION CIRCUIT", by T. Chen, Ser. No. 10/746,539, which is incorporated herein in its entirety.

This case is related to commonly assigned U.S. patent application "FEEDBACK-CONTROLLED BODY-BIAS VOLTAGE SOURCE", by T. Chen, U.S. patent application Ser. No. 10/747,016, filed on Dec. 23, 2003, which is incorporated herein in its entirety.

This case is related to commonly assigned U.S. patent application "SERVO-LOOP FOR WELL-BIAS VOLTAGE SOURCE", by Chen, et al., U.S. patent application Ser. No. 10/747,015, filed on Dec. 23, 2003, which is incorporated herein in its entirety.

TECHNICAL FIELD

Embodiments of the present invention relate to body biasing circuits for providing operational voltages in integrated circuit devices.

BACKGROUND ART

As the operating voltages for CMOS transistor circuits have decreased, variations in the threshold voltages for the transistors have become more significant. Although low operating voltages offer the potential for reduced power consumption and higher operating speeds, threshold voltage variations due to process and environmental variables often prevent optimum efficiency and performance from being achieved. Body-biasing is a prior art mechanism for compensating for threshold voltage variations. Body-biasing introduces a reverse bias potential between the bulk and the source of the transistor, allowing the threshold voltage of the transistor to be adjusted electrically. It is important that the circuits that implement and regulate the substrate body biasing function effectively and precisely. Inefficient, or otherwise substandard, body bias control can cause a number of problems with the operation of the integrated circuit, such as, for example, improper bias voltage at the junctions, excessive current flow, and the like.

DISCLOSURE OF THE INVENTION

Embodiments of the present invention provide a stabilization component for substrate potential regulation for an integrated circuit device.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE EMBODIMENTS

Reference will now be made in detail to the preferred embodiments of the present invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of embodiments of the present invention, numerous specific details are set forth in order to provide a thorough understanding of the present invention. However, it will be recognized by one of ordinary skill in the art that the present invention may be practiced without these specific details. In other instances, well-known methods, procedures, components, and circuits have not been described in detail as not to unnecessarily obscure aspects of the embodiments of the present invention.

Figure 1:
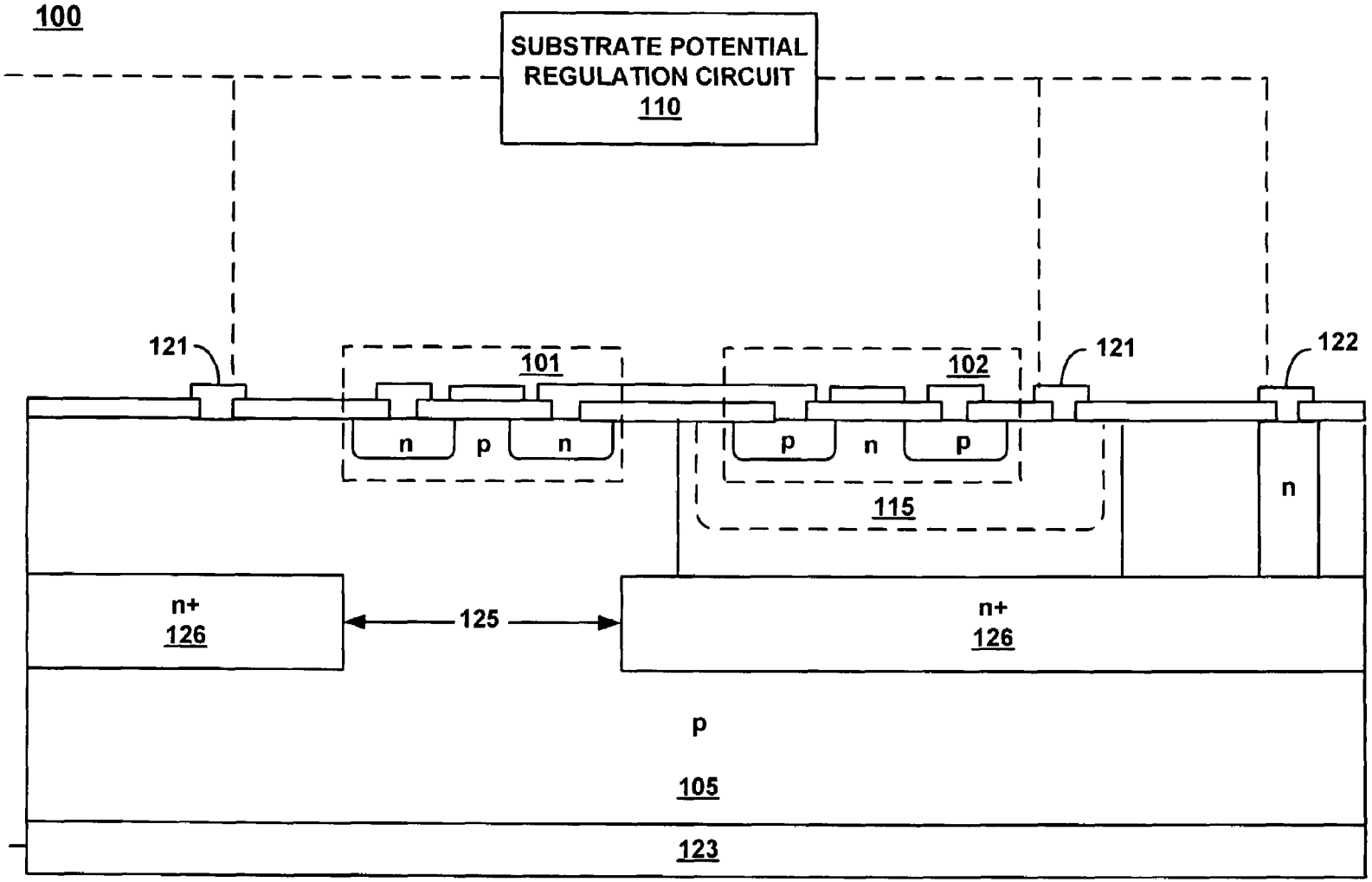
FIG. 1 shows an exemplary integrated circuit device in accordance with one embodiment of the present invention.

FIG. 1 shows an exemplary integrated circuit device 100 in accordance with one embodiment of the present invention. As depicted in FIG. 1, the integrated circuit device 100 shows an inverter having connections to a body-biasing substrate potential regulation circuit 110 (e.g., hereafter regulation circuit 110). The regulation circuit 110 is coupled to provide body bias currents to a PFET 102 through a direct bias contact 121, or by a buried n-well 126 using contact 122. In the FIG. 1 diagram, a p-type substrate 105 supports an NFET 101 and the PFET 102 resides within an n-well 115. Similarly, body-bias may be provided to the NFET 101 by a surface contact 121, or by a backside contact 123. An aperture 125 may be provided in the buried n-well 126 so that the bias potential reaches the NFET 110. In general, the PFET 120 or the NFET 110 may be biased by the regulation circuit 110 through one of the alternative contacts shown. The integrated circuit device 100 employs body-biasing via the regulation circuit 110 to compensate for any threshold voltage variations.

Additional description of the operation of a regulation circuit in accordance with embodiments of the present invention can be found in commonly assigned "FEEDBACK-CONTROLLED BODY-BIAS VOLTAGE SOURCE", by T. Chen, U.S. patent application Ser. No. 10/747,016, filed on Dec. 23, 2003, which is incorporated herein in its entirety.

Figure 2:
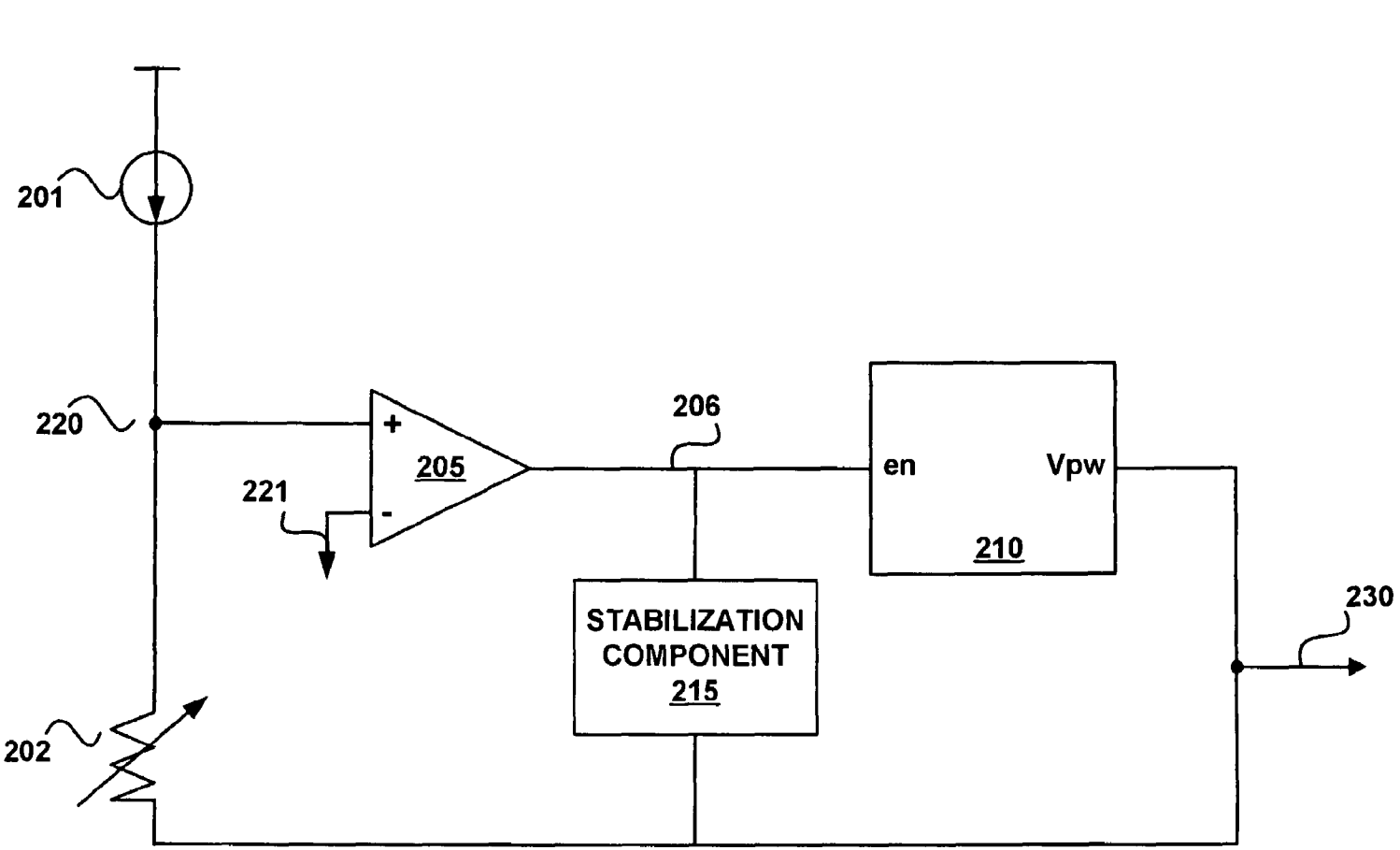
FIG. 2 shows a diagram depicting the internal components of the regulation circuit in accordance with one embodiment of the present invention.

FIG. 2 shows a diagram depicting the internal components of the regulation circuit 200 in accordance with one embodiment of the present invention. The regulation circuit 200 shows one exemplary component configuration suited for the implementation of the regulation circuit 110 shown in FIG. 1 above.

In the regulation circuit 200 embodiment, a current source 201 and a variable resistor 202 are coupled to generate a reference voltage at a node 220 (e.g., hereafter reference voltage 220) as shown. The reference voltage 220 is coupled as an input for a comparator 205. The output of the comparator 205 is coupled to a charge pump 210 and a stabilization component 215. The output of the regulation circuit 200 is generated at an output node 230. The output node 230 can be coupled to one or more body bias contacts of an integrated circuit device (e.g., the contacts 121-123 shown in FIG. 1).

In the regulation circuit 200 embodiment, the current source 201 and the variable resistor 202 form a control circuit, or control component, that determines the operating point of the regulation circuit 200. The current source 201 and the variable resistor 202 determine the reference voltage 220. The comparator 205 examines the reference voltage 220 and the ground voltage 221 and switches on if the reference voltage 220 is higher than the ground voltage 221. The comparator output 206 turns on the charge pump 210, which actively drives the output node 230 to a lower (e.g., negative) voltage. The effect of turning on the charge pump 210 is to actively drive the body bias of a coupled integrated circuit to a lower voltage. This lower voltage will eventually be seen at the reference voltage node 220 of the comparator 205. Once the reference voltage 220 and the ground voltage 221 are equalized, the comparator will switch off, thereby turning off the charge pump 210. With the constant reference current from the current source 201, the body bias of the integrated circuit device will thus be equal to the voltage drop across the variable resistor 202.

Once the charge pump 210 is turned off, the body bias of the integrated circuit device will rise over time as the numerous components of the integrated circuit device sink current to ground. When the reference voltage 220 rises above the ground voltage 221, the comparator 205 will switch on the charge pump 210 to re-establish the desired body bias. A typical value for the integrated circuit device is 2.5 volts.

As described above, the current source 201 and the variable resistor 202 determine the reference voltage 220, and thus, the operating point of the regulation circuit 200. The reference voltage 220 is generated by a reference current flowing from the current source 201 through the variable resistor 202. Accordingly, the reference voltage 220 is adjusted by either adjusting the reference current or adjusting the resistance value of the variable resistor 202.

In one embodiment, the reference current is designed for stability and is controlled by a band gap voltage source of the integrated circuit device. Thus, as the temperature of the device changes, the reference current should be stable. Additionally, the reference current should be stable across normal process variation. A typical value for the reference current is 10 microamps. In such an embodiment, the reference voltage 220 is adjusted by changing the variable resistance 202.

In the present embodiment, the stabilization component 215 functions as a stabilizing shunt that prevents over charging of the body bias. As described above, once the charge pump 210 is turned off, the body bias of the integrated circuit device will rise over time as the integrated circuit device sinks current to ground. The stabilization component 215 functions in those cases when the charge pump 210 overcharges the body bias.

Figure 3:
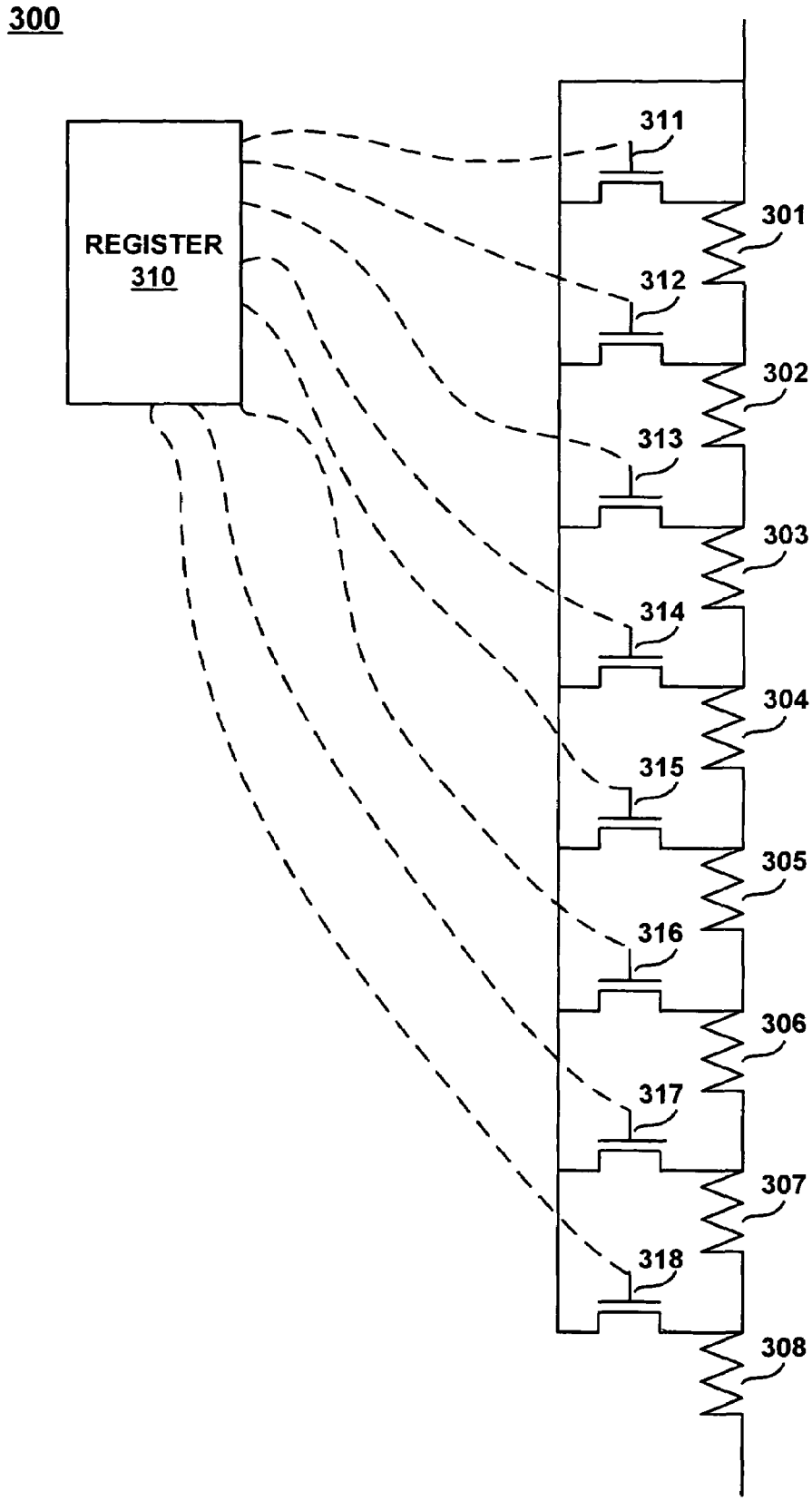
FIG. 3 shows a diagram of a resistor chain in accordance with one embodiment of the present invention.

FIG. 3 shows a diagram of a resistor chain 300 in accordance with one embodiment of the present invention. The resistor chain 300 shows one configuration suited for the implementation of the variable resistor 202 shown in FIG. 2 above. The resistor chain 300 comprises a chain of resistor elements 301-308 arranged in series. In the present embodiment, a resistance value for the resistor chain 300 is selected by tapping a selected one of the resistor elements 301-308. This is accomplished by turning on one of the coupled transistors 311-318. For example, increasing the resistance value is accomplished by tapping a resister earlier in the chain (e.g., resistor 301) 300 as opposed to later in the chain (e.g., resistor 307). The resistance value is selected by writing to a configuration register 310 coupled to control the transistors 311-318.

Figure 4:
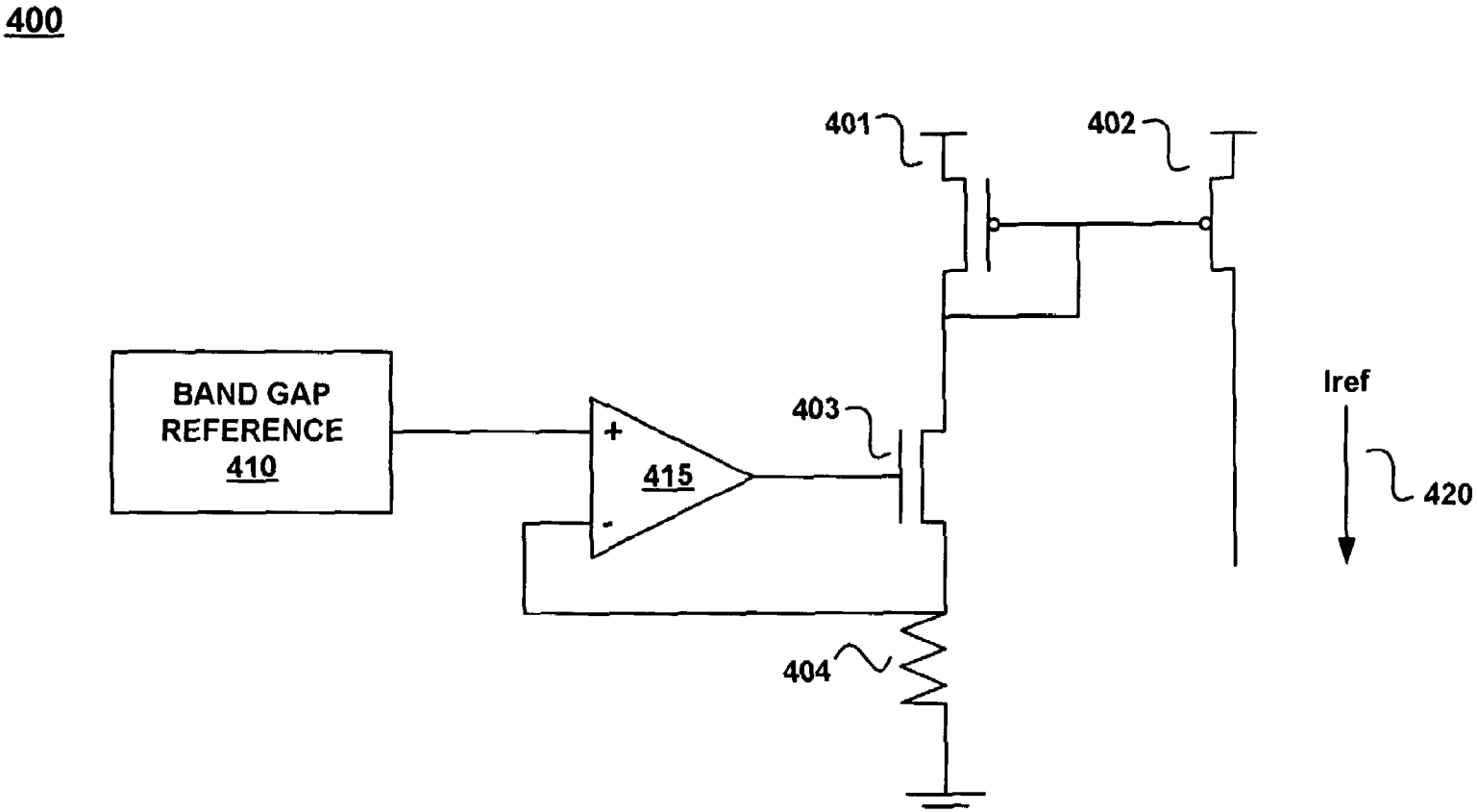
FIG. 4 shows a diagram of a current source in accordance with one embodiment of the present invention.

FIG. 4 shows a diagram of a current source 400 in accordance with one embodiment of the present invention. The current source 400 shows one configuration suited for the implementation of the current source 201 shown in FIG. 2. The current source 400 includes a band gap voltage reference 410 coupled to an amplifier 415. The amplifier 415 controls the transistor 403, which in turn controls the current flowing through the transistor 401 and the resistor 404. This current is mirrored by the transistor 402, and is the reference current generated by the current source 400 (e.g., depicted as the reference current 420).

In this embodiment, the use of a band gap voltage reference 410 results in a stable reference current 420 across different operating temperatures and across different process corners. The reference voltage 220 is governed by the expression K*Vbg, where K is the ratio of the variable resistor 202 and the resistance within the band gap reference 410 and Vbg is the band gap voltage.

Figure 5:
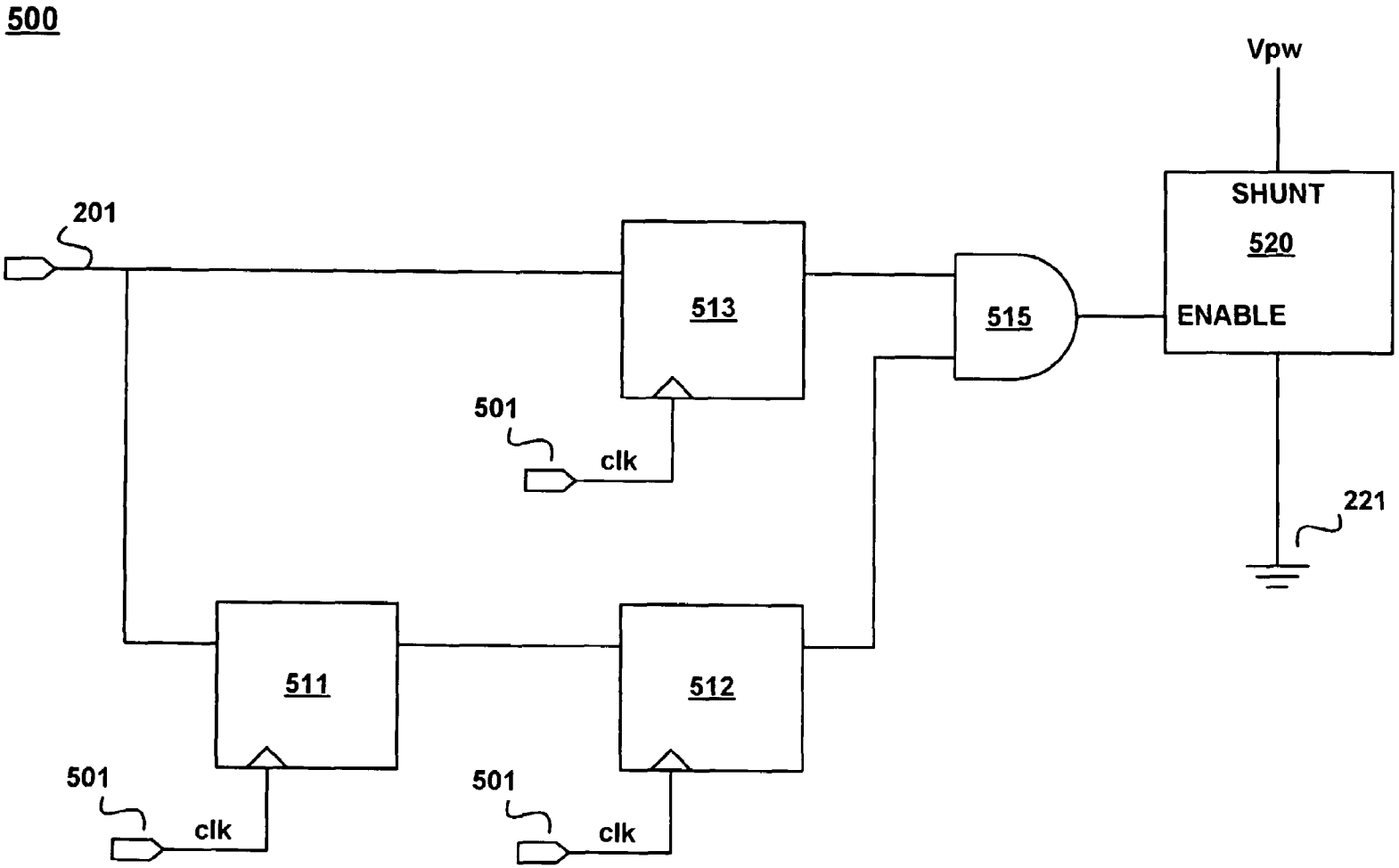
FIG. 5 shows a diagram of a stabilization component in accordance with one embodiment of the present invention.

FIG. 5 shows a diagram of a stabilization component 500 in accordance with one embodiment of the present invention. The stabilization component 500 shows one configuration suited for the implementation of the stabilization component 215 shown in FIG. 2. In the present embodiment, the stabilization component 500 functions as a stabilizing shunt that prevents over charging of the body bias.

As described above, once the charge pump 210 is turned off, the body bias of the integrated circuit device, and thus the ground voltage 221, will rise over time as the integrated circuit device sinks current to ground. The stabilization component 215 functions in those cases when the charge pump 210 overcharges the body bias. For example, there may be circumstances where the charge pump 210 remains on for an excessive amount of time. This can cause an excessive negative charge in the body of the integrated circuit device. The stabilization component 215 can detect an excessive charging action of the charge pump 210.

When excessive charging is detected (e.g., the charge pump 210 being on too long), the stabilization component 215 can shunt current directly between ground and the body bias (e.g., Vpw), thereby more rapidly returning the body bias voltage to its desired level. When the reference voltage 220 rises to the ground voltage 221, the comparator 205 will switch on the charge pump 210 to maintain the desired body bias.

In the stabilization component 500 embodiment, the output of the comparator 205 is coupled as an input to three flip-flops 511-513. The flip-flops 511-513 receive a common clock signal 501. The flip-flops 511 and 512 are coupled in series as shown. The outputs of the flip-flops 512 and 513 are inputs to the AND gate 515. The AND gate 515 controls the enable input of a shunt switch 520.

In normal operation, the comparator output 206 will cycle between logic one and logic zero as the comparator 205 turns on and turns off the charge pump 210 to maintain the voltage reference 220 in equilibrium with ground 221. Thus, the output 206 will oscillate at some mean frequency (e.g., typically 40 MHz). The clock signal 501 is typically chosen to match this frequency. If the comparator output 206 remains high for two consecutive clock cycles, the shunt switch 520 will be enabled, and current will be shunted between, in a negative charge pump case, between Vpw and ground, as depicted. In a positive charge pump case (e.g., FIG. 6) current will be shunted between Vnw and Vdd.

Figure 6:
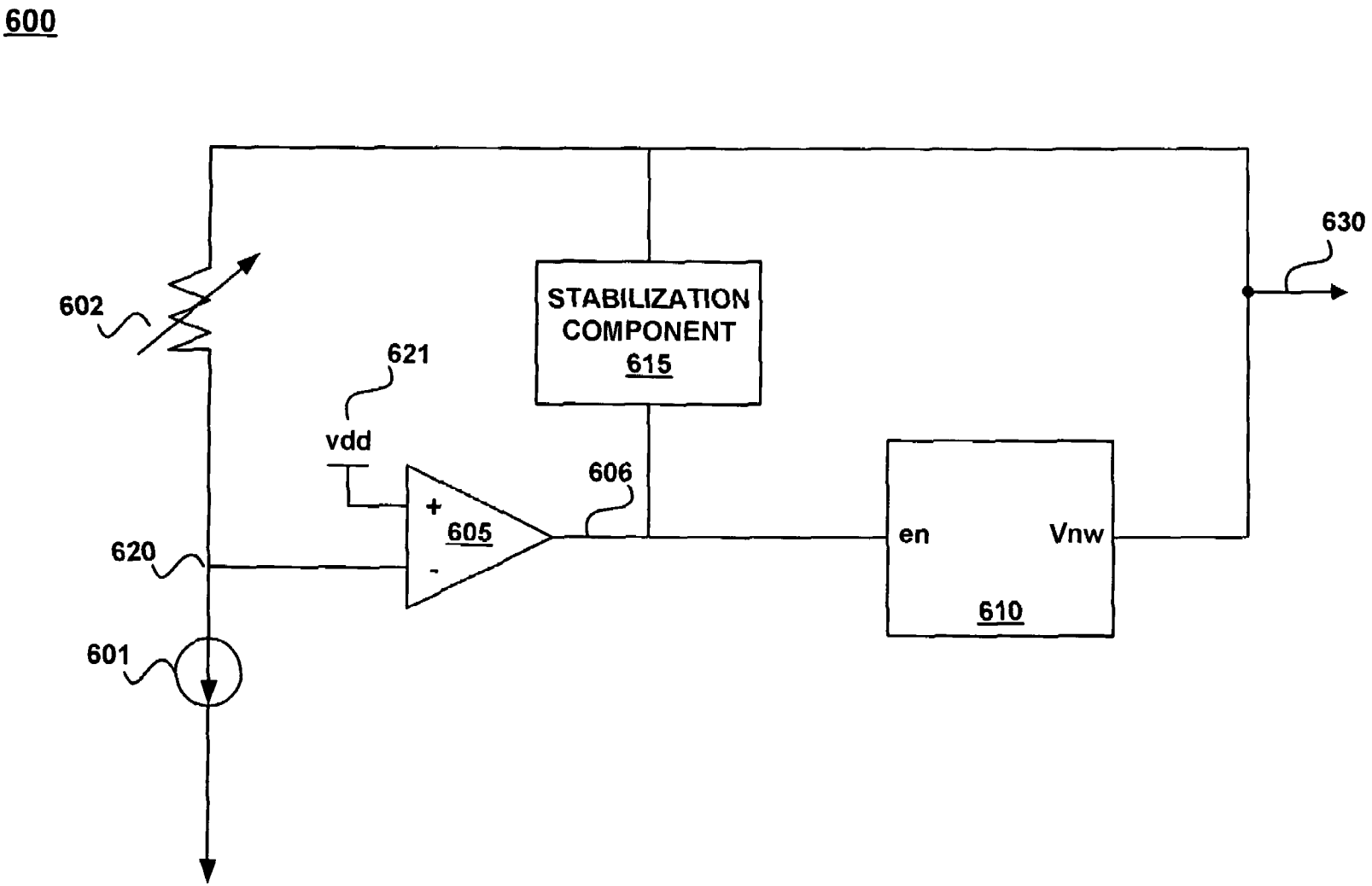
FIG. 6 shows a diagram of a positive charge pump regulation circuit in accordance with one embodiment of the present invention.

FIG. 6 shows a diagram of a positive charge pump regulation circuit 600 in accordance with one embodiment of the present invention. The regulation circuit 600 shows one exemplary component configuration suited for the implementation of a positive charge pump (e.g., Vnw) version of the regulation circuit 110 above.

The regulation circuit 600 embodiment functions in substantially the same manner as the circuit 200 embodiment. A current source 601 and a variable resistor 602 are coupled to generate a reference voltage at a node 620 as shown. The reference voltage 620 is coupled as an input for a comparator 605. The output of the comparator 605 controls a charge pump 610 and a stabilization component 615. The output of the regulation circuit 600 is generated at an output node 630 and is for coupling to the Vnw body bias contacts of an integrated circuit device.

As with the circuit 200 embodiment, the current source 601 and the variable resistor 602 form a control circuit that determines the operating point. The comparator 605 and the charge pump 610 actively drive the output node 630 to force the reference voltage 620 and Vdd 621 into equilibrium. With the constant reference current from the current source 601, the Vnw body bias of the integrated circuit device will thus be equal to the voltage drop across the variable resistor 602.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A stabilization system for substrate potential regulation for an integrated circuit device, said stabilization system comprising:

a comparator operable to compare a reference voltage to a ground voltage of the integrated circuit device;

a negative charge pump coupled to the comparator, wherein an output of the comparator is coupled to an input of the negative charge pump, wherein the negative charge pump is controlled by the comparator and operable to drive down a potential of a substrate of the integrated circuit device when the reference voltage is greater than the ground voltage; and a stabilization component coupled to the input of the negative charge pump and the output of the comparator, wherein the stabilization component is operable to shunt current between the substrate and a ground of the integrated circuit device to correct an over-charge of the substrate by the negative charge pump, and wherein the stabilization component is further operable to shunt the current responsive to detecting that a duration of the over-charge exceeds a predetermined number of clock cycles.

2. The stabilization system of claim 1 further comprising:

a current source; and a resistor coupled to the current source and to an output of the negative charge pump, wherein the current source in combination with the resistor generates the reference voltage.

3. The stabilization system of claim 2, wherein the resistor is a variable resistor.

4. The stabilization system of claim 1, wherein the stabilization component is configured to correct the over-charge by shunting current between a P-type well of the integrated circuit device and the ground of the integrated circuit device.

5. The stabilization system of claim 1, wherein the stabilization component comprises:

a plurality of storage elements having a common clock and operable to detect the negative charge pump active for more than the predetermined number of clock cycles; and a shunt switch coupled to the plurality of storage elements and operable to shunt a current from the substrate when the negative charge pump is active for more than the predetermined number of clock cycles.

6. The stabilization system of claim 5, wherein the predetermined number of clock cycles is two clock cycles.

7. A stabilization system for substrate potential regulation for an integrated circuit device, said stabilization system comprising:

a comparator operable to compare a reference voltage to a power supply voltage of the integrated circuit device;

a positive charge pump coupled to the comparator, wherein an output of the comparator is coupled to an input of the positive charge pump, wherein the positive charge pump is controlled by the comparator and operable to drive up a potential of a substrate of the integrated circuit device when the reference voltage is less than the power supply voltage; and a stabilization component coupled to the output of the comparator and operable to shunt current from the substrate to correct an over-charge of the substrate by the positive charge pump, and wherein the stabilization component is further operable to shunt the current responsive to detecting that a duration of the over-charge exceeds a predetermined number of clock cycles.

8. The stabilization system of claim 7 further comprising:

a current source; and a resistor coupled to the current source and to an output of the positive charge pump, wherein the current source in combination with the resistor generates the reference voltage.

9. The stabilization system of claim 8, wherein the resistor is a variable resistor.

10. The stabilization system of claim 7, wherein the stabilization component is configured to correct the over-charge by shunting current between an N-type well of the integrated circuit device and a component of the integrated circuit device associated with the power supply voltage.

11. The stabilization system of claim 7 wherein the stabilization component comprises:

a plurality of storage elements having a common clock and operable to detect the positive charge pump active for more than the predetermined number of clock cycles; and a shunt switch coupled to the plurality of storage elements and operable to shunt a current from the substrate when the positive charge pump is active for more than the predetermined number of clock cycles.

12. The stabilization system of claim 11, wherein the predetermined number of clock cycles is two clock cycles.

13. A method for integrated circuit device substrate potential regulation, said method comprising:

comparing, using a comparator, a reference voltage to a first voltage of the integrated circuit device;

driving a potential of a substrate of the integrated circuit device based upon a result of said comparing the reference voltage to the first voltage;

measuring a duration of an over-charging of the substrate, wherein said measuring further comprises determining the duration from the output of the comparator; and upon detecting that the duration exceeds a predetermined number of clock cycles, shunting current between the substrate and a component of the integrated circuit device to correct the over-charging of the substrate.

14. The method of claim 13, wherein the driving a potential comprises:

driving the potential of the substrate down when the reference voltage is greater than a ground voltage.

15. The method of claim 14, wherein said shunting current further comprises:

shunting current between a P-type well and a ground of the integrated circuit device.

16. The method of claim 13, wherein said driving a potential further comprises:

driving the potential of the substrate up when the reference voltage is less than a power supply voltage.

17. The method of claim 16, wherein said shunting current further comprises:

shunting current between an N-type well and a component of the integrated circuit device associated with the power supply voltage.

18. A stabilization system for substrate potential regulation for an integrated circuit device, said stabilization system comprising:

a comparator operable to compare a reference voltage to a voltage of the integrated circuit device;

a charge pump coupled to the comparator, wherein an output of the comparator is coupled to an input of the charge pump, wherein the charge pump is controlled by the comparator and operable to adjust a potential of a substrate of the integrated circuit device; and a stabilization component coupled to the input of the charge pump and the output of the comparator, wherein the stabilization component is operable to shunt current from the substrate to correct an over-charge of the substrate by the charge pump, wherein the stabilization component is further operable to shunt the current from the substrate in response to a duration of the over-charge exceeding a predetermined number of clock cycles, wherein the stabilization component is further operable to shunt the current based on the output of the comparator, and wherein the stabilization component comprises:

a plurality of storage elements having a common clock and operable to detect the charge pump active for more than a predetermined number of clock cycles; and a shunt switch coupled to the plurality of storage elements and operable to shunt a current from the substrate when the charge pump is active for more than the predetermined number of clock cycles.

19. The stabilization system of claim 18, wherein the charge pump comprises a negative charge pump, and wherein the charge pump is controlled by the comparator and operable to drive down a potential of a substrate of the integrated circuit device when the reference voltage is greater than the ground voltage.

20. The stabilization system of claim 19, wherein the voltage of the integrated circuit device is a ground voltage of the integrated circuit device.

21. The stabilization system of claim 20, wherein the stabilization component is configured to correct the over-charge by shunting current between a P-type well of the integrated circuit device and a ground of the integrated circuit device.

22. The stabilization system of claim 18, wherein the charge pump comprises a positive charge pump, and wherein the positive charge pump is controlled by the comparator and operable to drive up a potential of a substrate of the integrated circuit device when the reference voltage is less than the power supply voltage.

23. The stabilization system of claim 22, wherein the voltage of the integrated circuit device is a power supply voltage of the integrated circuit device.

24. The stabilization system of claim 23, wherein the stabilization component is configured to correct the over-charge by shunting current between an N-type well of the integrated circuit device and a component of the integrated circuit device associated with the power supply voltage.

25. The stabilization system of claim 18 further comprising:

a current source; and a resistor coupled to the current source and to an output of the charge pump, wherein the current source in combination with the resistor generates the reference voltage.

26. A stabilization system for substrate potential regulation for an integrated circuit device, said stabilization system comprising:

means for comparing, using a comparator, a reference voltage to a first voltage of the integrated circuit device;

means for driving a potential of a substrate of the integrated circuit device based upon a result of said comparing the reference voltage to the first voltage;

means for measuring a duration of an over-charging of the substrate, wherein said measuring further comprises determining the duration from the output of the comparator; and means for shunting current, upon detecting that the duration exceeds a predetermined number of clock cycles, between the substrate and a component of the integrated circuit device to correct the over-charging of the substrate.

27. The stabilization system of claim 26, wherein the means for driving a potential includes means for driving the potential of the substrate down when the reference voltage is greater than a ground voltage.

28. The stabilization system of claim 27, wherein the means for shunting current includes means for shunting current between a P-type well and a ground of the integrated circuit device.

29. The stabilization system of claim 26, wherein the means for driving a potential further includes means for driving the potential of the substrate up when the reference voltage is less than a power supply voltage.

30. The stabilization system of claim 29, wherein the means for shunting current further includes means for shunting current between an N-type well and a component of the integrated circuit device associated with the power supply voltage.

* * * * *